US006912868B2

(12) United States Patent
Sugie et al.

(10) Patent No.: US 6,912,868 B2
(45) Date of Patent: Jul. 5, 2005

(54) AUGER TYPE ICE-MAKING MACHINE

(75) Inventors: Hiroyuki Sugie, Tokai (JP); Kazunori Matsuo, Toyoake (JP); Yasuki Mizutani, Toyoake (JP); Tomohito Nomura, Toyoake (JP); Mika Hamajima, Obu (JP)

(73) Assignee: Hoshizaki Electric Co., Ltd., Aichi (JP)

( * ) Notice: Subject to any disclaimer, the term of this patent is extended or adjusted under 35 U.S.C. 154(b) by 0 days.

(21) Appl. No.: 10/717,436

(22) Filed: Nov. 19, 2003

(65) Prior Publication Data

US 2004/0163406 A1 Aug. 26, 2004

(30) Foreign Application Priority Data

Nov. 19, 2002 (JP) ..... P2002-335412

(51) Int. Cl.[7] ..... F25C 1/14
(52) U.S. Cl. ..... 62/354; 219/544
(58) Field of Search ..... 62/351, 354; 219/544

(56) References Cited

U.S. PATENT DOCUMENTS 3,383,493 A * 5/1968 Jobst ..... 219/200

FOREIGN PATENT DOCUMENTS

| | | | |
|---|---|---|---|
| JP | 57-128068 | 8/1982 | ..... F25C/1/14 |
| JP | 59-18363 | 1/1984 | ..... F25C/1/14 |
| JP | 10-2645 | 1/1998 | ..... F25C/1/14 |
| JP | 10-253211 | 9/1998 | ..... F25C/1/14 |
| JP | 2000-171135 | 6/2000 | ..... F25C/1/14 |
| JP | 2002-13847 | 1/2002 | ..... F25C/1/14 |
| JP | 2003-121036 | 4/2003 | ..... F25C/1/14 |

OTHER PUBLICATIONS

Abstract of Japanese Utility Model, Publication No.: S57–128068, Date of Publication: Aug. 10, 1982, 1 page.
Patent Abstracts of Japan, Publication No.: 10–253211, Date of Publication: Sep. 25, 1998, 2 pages.
Patent Abstracts of Japan, Publication No. 2002–013847, Date of Publication: Jan. 18, 2002, 2 pages.

Japanese International Search Report dated Jan. 13, 2004, 2 pages.

International Search Report dated Jan. 13, 2004, 2 pages.

Abstracts of Japanese Utility Model, Publication No:. S57–128068, Date of Publication: Aug. 10, 1982, 1 page.

Patent Abstracts of Japan, Publication No.: 10–253211, Date of Publication: Sep. 25, 1998, 2 pages.

Patent Abstracts of Japan, Publication No.: 2002–013847, Date of Publication: Jan. 18, 2002, 2 pages.

Patent Abstracts of Japan, Publication No. 10–002645, Date of Publication: Jan. 6, 1998, 1 page.

Partial Translation of Japanese Patent Application Laid–Open No. SH059–018363, 2 pages.

Patent Abstracts of Japan, Publication No.: 2000–171135, Date of Publication: Jun. 23, 2000, 1 page.

Patent Abstracts of Japan, Publication No.: 2003–121036, Date of Publication: Apr. 23, 2003, 1 page.

* cited by examiner

*Primary Examiner*—William E. Tapolcai
(74) *Attorney, Agent, or Firm*—Osha Liang LLP

(57) ABSTRACT

An auger type ice-making machine of the present invention comprises an ice-making cylinder which accommodates an auger rotatably in the interior thereof, an ice compression head which supports the upper end portion of the auger rotatably, and which is disposed in the upper portion of the ice-making cylinder, and a cast-in heater which is attached to the outer peripheral surface of an accommodating portion for the ice compression head of the ice-making cylinder. According to the present invention, the use of a cast-in heater enables heat to be reliably transmitted to the ice compression head, whereby the compressed ice can be melted and ice can be discharged smoothly.

10 Claims, 9 Drawing Sheets

AUGER TYPE ICE-MAKING MACHINE

BACKGROUND OF THE INVENTION

1. Field of the Invention

The present invention relates to an auger type ice-making machine which manufactures chip-form or flake-form ice by freezing ice-making water that is supplied to the interior of an ice-making cylinder while rotating an auger in the interior of the ice-making cylinder via a geared motor.

2. Related Background Art

Various sorts of auger type ice-making machines have been proposed in the past (see Japanese Patent Application Laid-Open No. H10-2645 and Japanese Patent Application Laid-Open No. S59-18363). In such auger type ice-making machines, an auger (screw) is supported rotatably inside a tubular ice-making cylinder between an ice compression head (also known as a fixed blade) that is disposed in the upper portion of the ice-making cylinder and a housing that is disposed in the lower portion of the ice-making cylinder. Then, while ice-making water that is supplied to the interior of the ice-making cylinder is frozen, the auger rotates via a geared motor connected to the lower end portion of the auger inside the housing, so that sherbet ice produced by the freezing of this ice-making water is introduced into the ice compression head. This sherbet ice is compressed by the ice compression head to produce chip-form or flake-form ice.

A belt-form heater for precipitating the discharge of ice from the ice compression head is attached to the upper portion of the freezer casing of such an auger type ice-making machine. This heater is used to slightly melt the surface of the ice that is compressed in the ice compression head so that the ice can be easily discharged from the ice compression head. Conventionally, a film-form or tape-form silicone cord heater or silicone mold heater is used as the heater, and is wrapped around the outer peripheral surface of the ice compression head accommodating portion of the ice-making cylinder.

However, when such a heater is wrapped irregularly or wrapped around an attachment part (the upper outer peripheral surface of the ice-making cylinder) having a complex form (with stepped surface), adhesion thereof to the attachment part may be poor, as a result of which the heat from the heater may not be sufficiently transmitted to the ice compression head through the ice-making cylinder, and the heater may not be able to function sufficiently as a melting heater. Another concern is that due to the lack of adhesion, the heater may overheat, hastening the deterioration of the silicone and causing electric leakage and wire breakage.

SUMMARY OF THE INVENTION

An object of the present invention is to provide an auger type ice-making machine which is capable of discharging ice smoothly by causing a heater which melts ice following manufacture in an ice compression head portion to function reliably.

An auger type ice-making machine of the present invention comprises an ice-making cylinder which accommodates an auger rotatably in the interior thereof, an ice compression head which supports the upper end portion of the auger rotatably, and which is disposed in the upper portion of the ice-making cylinder, and cast-in heating means attached to the outer peripheral surface of an accommodating portion for the ice compression head of the ice-making cylinder.

Here, when the cast-in heating means comprise an interior heater which generates heat by electricity, an advantage is gained in that heat control through electric power can be performed with ease.

If the cast-in heating means comprise a heater which generates heat by circulating a heated fluid (a hot fluid: hot gas or a liquid such as warm oil) through its interior, then energy can be saved since electric power is not used, and there is no need to provide measures against electric leakage caused by condensation. Further, since the cast-in heater is constituted chiefly by only two parts, the pipe and the cast material (aluminum material or the like), component costs and the number of manufacturing processes can be greatly reduced. Since it is also possible to make use of the heat that is generated by a refrigerating unit of the ice-making machine, the cast-in heater can also be used as a cooling component. In this case, the cast-in heater functions not only as an ice-melting heater, but also as a heat exchanger, thus contributing to an improvement in the ice-making performance.

It is preferable here that the cast-in heating means be fixed to the outer peripheral surface of the ice-making cylinder with sandwiching a good thermal conductive plate.

DESCRIPTION OF THE PREFERRED EMBODIMENTS

Figure 1:
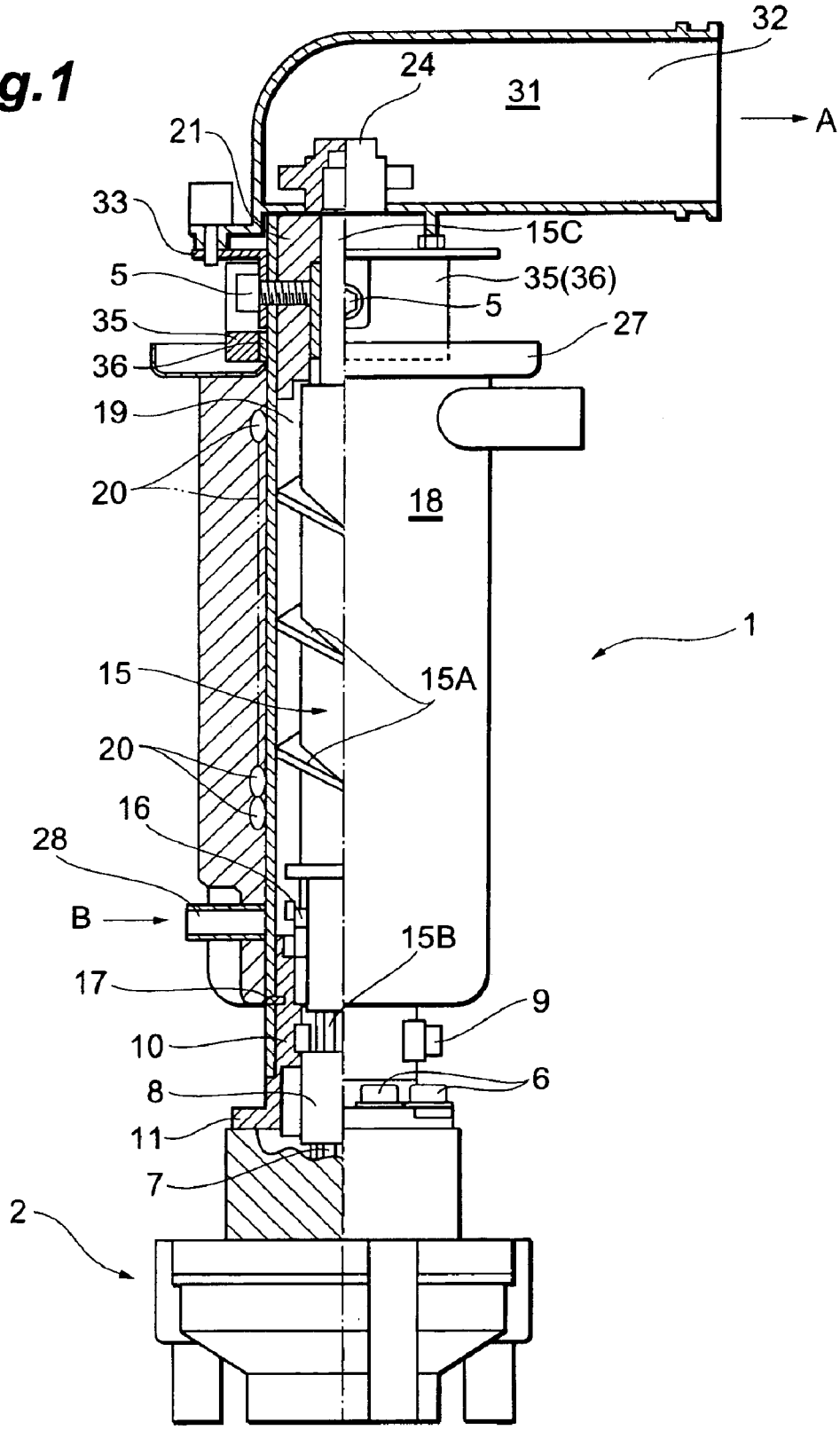
FIG. 1 is a sectional view showing an embodiment of an auger type ice-making machine of the present invention.
Figure 2:
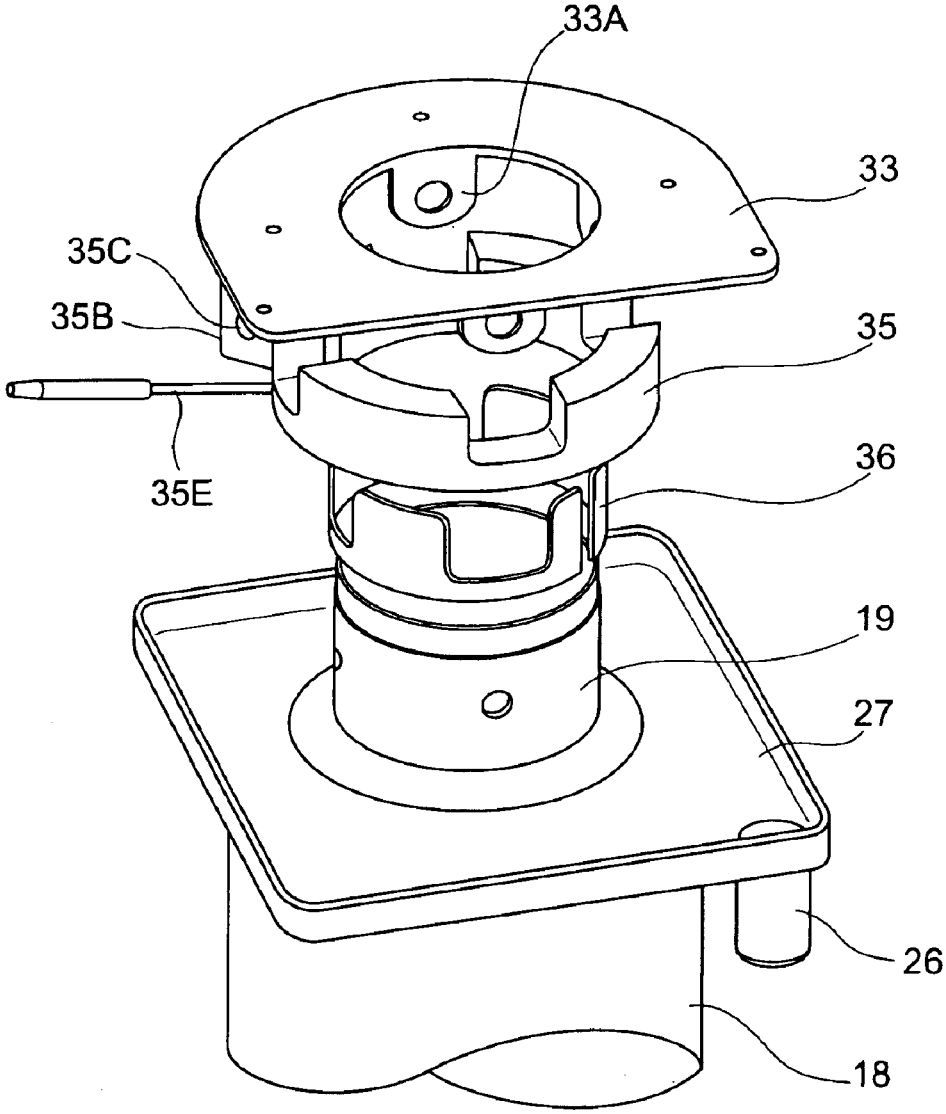
FIG. 2 is an exploded perspective view of the vicinity of an ice compression head in an embodiment of the auger type ice-making machine of the present invention.
Figure 3:
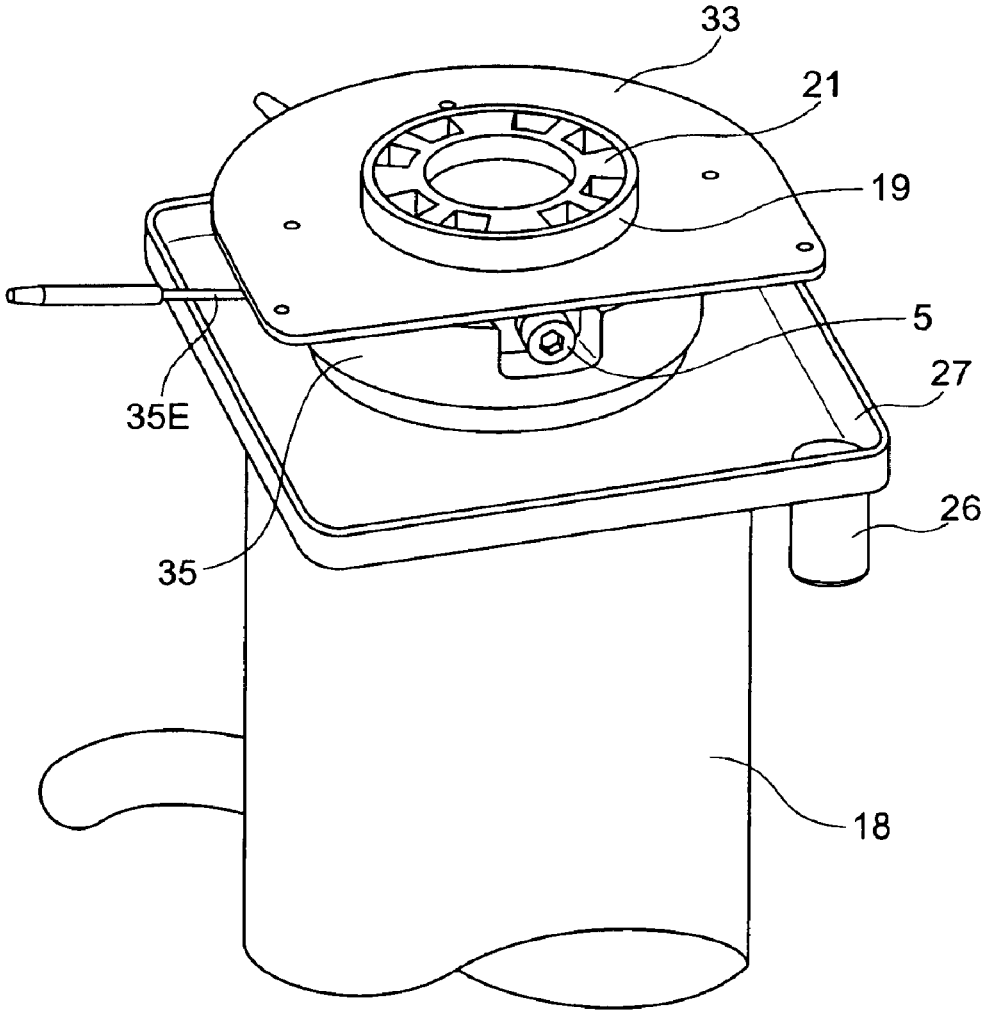
FIG. 3 is a perspective view of the vicinity of the ice compression head in an embodiment of the auger type ice-making machine of the present invention following assembly.

Embodiments of the auger type ice-making machine of the present invention will be described below with reference to the drawings. First, the constitution of the auger type ice-making machine of the present embodiments will be described on the basis of FIGS. 1 and 2. FIG. 1 is a sectional view of the auger-type ice-making machine (a side view is shown to the right of the figure). FIG. 2 is an exploded perspective view of the vicinity of an ice compression head serving as a main part of the present invention. FIG. 3 is a perspective view of the vicinity of the ice compression head following assembly.

As is shown in FIG. 1, a geared motor 2 is disposed in the lower portion of an auger type ice-making machine 1. In this geared motor 2, a driving motor and a speed reduction gear are constructed as an integral unit. The lower end of a spline joint 8 is attached to an output shaft 7 of the speed reduction gear, and the spline joint 8 and a lower end portion 15B of an auger 15 are rotatably supported by housing 10. The housing 10 is superimposed on a flange portion 11 formed on the lower portion of the housing 10, whereupon the housing 10 and flange portion 11 are fastened together in a plurality of locations by hexagonal-hole-equipped bolts 6. The housing 10 is formed from a copper alloy, and bearings made of a resin are press-fitted inside the housing 10. The housing 10 acts to connect and fix the geared motor 2 and a freezer casing 18 to each other. The lower portion of the freezer casing 18 and the housing 10 are fastened and fixed together in a plurality of locations by hexagonal-hole-equipped bolts 9.

The auger 15 is made of stainless steel, and has a configuration in which a spiral auger blade 15A is formed around the cylindrical central portion thereof. This auger blade 15A pushes sherbet ice grown inside the freezer casing 18 toward the top of the freezer casing 18 while scraping this sherbet ice from the inside walls of the freezer casing 18. Note that a mechanical seal 16 is disposed in a position above the lower end portion 15B of the auger 15. This mechanical seal 16 forms a seal so that the ice-making water that is supplied to the interior of the freezer casing 18 does not leak. Further, an O-ring 17 is disposed on the peripheral wall of the housing 10.

The freezer casing 18 has an interior stainless steel ice-making cylinder 19, and a heat insulating material (foam polyurethane) is disposed on the outside of this ice-making cylinder 19. A copper cooling pipe 20 is wound around the outer periphery (the interior of the heat insulating material) of the ice-making cylinder 19. This cooling pipe 20 is connected to a universally known freezer unit (consisting of a compressor, condenser, and so on). The cooling medium that is introduced into the cooling pipe 20 is evaporated inside the cooling pipe 20 as a result of a dramatic fall in pressure. At this time, the cooling medium captures a large quantity of vaporization heat, causing the temperature inside the ice-making cylinder 19 to fall rapidly. As a result, ice-making water is frozen on the inside surfaces of the ice-making cylinder 19. Note that since the constitution of this freezer unit is universally known, a detailed description thereof has been omitted here.

As shown in FIGS. 1 through 3, an ice compression head 21 made of stainless steel is fixed to the upper end portion of the ice-making cylinder 19 at an upper position of the freezer casing 18. This ice compression head 21 and the upper portion of the ice-making cylinder 19 are fastened to each other in a plurality of locations by means of hexagonal-hole-equipped bolts 5. These hexagonal-hole-equipped bolts 5 also fasten an attachment portion 33A of a flange 33. The attachment portion 33A also functions as a washer during fixing of the bolts 5. Further, bearings made of a resin are mounted inside the ice compression head 21, and the upper end portion 15C of the auger 15 which passes through the interior of the ice-making cylinder 19 is rotatably supported on these bearings.

Furthermore, a cutter 24 is fixed to the top of the upper end portion 15C of the auger 15. This cutter 24 rotates with the rotation of the auger 15. The ice compression head 21 functions as a fixed blade, whereby the sherbet ice that is pushed upward through the interior of the ice-making cylinder 19 while being scraped from the inner surface of the ice-making cylinder 19 by the auger 15, as described above, is compressed into columnar ice by the ice compression head 21. The compressed columnar ice is raised further, and is cut by the cutter 24 into chip-form or flake-form ice. The chip-form or flake-form ice thus produced is discharged from an ice discharging portion 31 in the direction indicated by the arrow A.

An ice discharge tube 32 made of a resin, which regulates the discharge direction of the ice that has been finely cut by the cutter 24, is attached to the ice discharging portion 31. This ice discharge tube 32 is attached to the upper end of the ice-making cylinder 19 using a flange 33 that is attached to the upper portion of the ice-making cylinder 19 as an attachment base portion. Note that an outer cylinder 36 made of copper and having a form which fits together with the plurality of attachment portions 33A of the flange is provided on the outer peripheral surface of the ice-making cylinder 19. The outer cylinder 36 is constituted by a copper plate, which is a metal plate having good thermal conductivity, and takes a tubular form having slits formed in the axial direction. The outer cylinder 36 is also provided with a plurality of cut-away portions in order to avoid the aforementioned hexagonal-hole-equipped bolts 5 (that is, the attachment portions 33A). An aluminum cast-in heater 35 is disposed on the outer peripheral surface of the outer cylinder 36.

Further, a dew receiving dish 27 which has a drainage pipe 26 formed as an integral part is disposed on the upper portion of the freezer casing 18. This dew receiving dish 27 is welded to the ice-making cylinder 19 (but may be fixed by bolts, in which case the bolts 5 and so on are used to fasten the dew receiving dish 27), and serves to capture the condensed water that condenses in the vicinity of the hexagonal-hole-equipped bolts 5 and discharge the captured condensed water through the drainage pipe 26. Moreover, a water inlet port 28 that communicates with the interior of the ice-making cylinder 19 is formed in the lower portion of the freezer casing 18. A universally known ice-making water supply tank is connected to this water inlet port 28, and ice-making water that is supplied to the interior of the ice-making cylinder 19 from the water inlet port 28 in the direction indicated by the arrow B is made into ice inside the ice-making cylinder 19.

Figure 4:
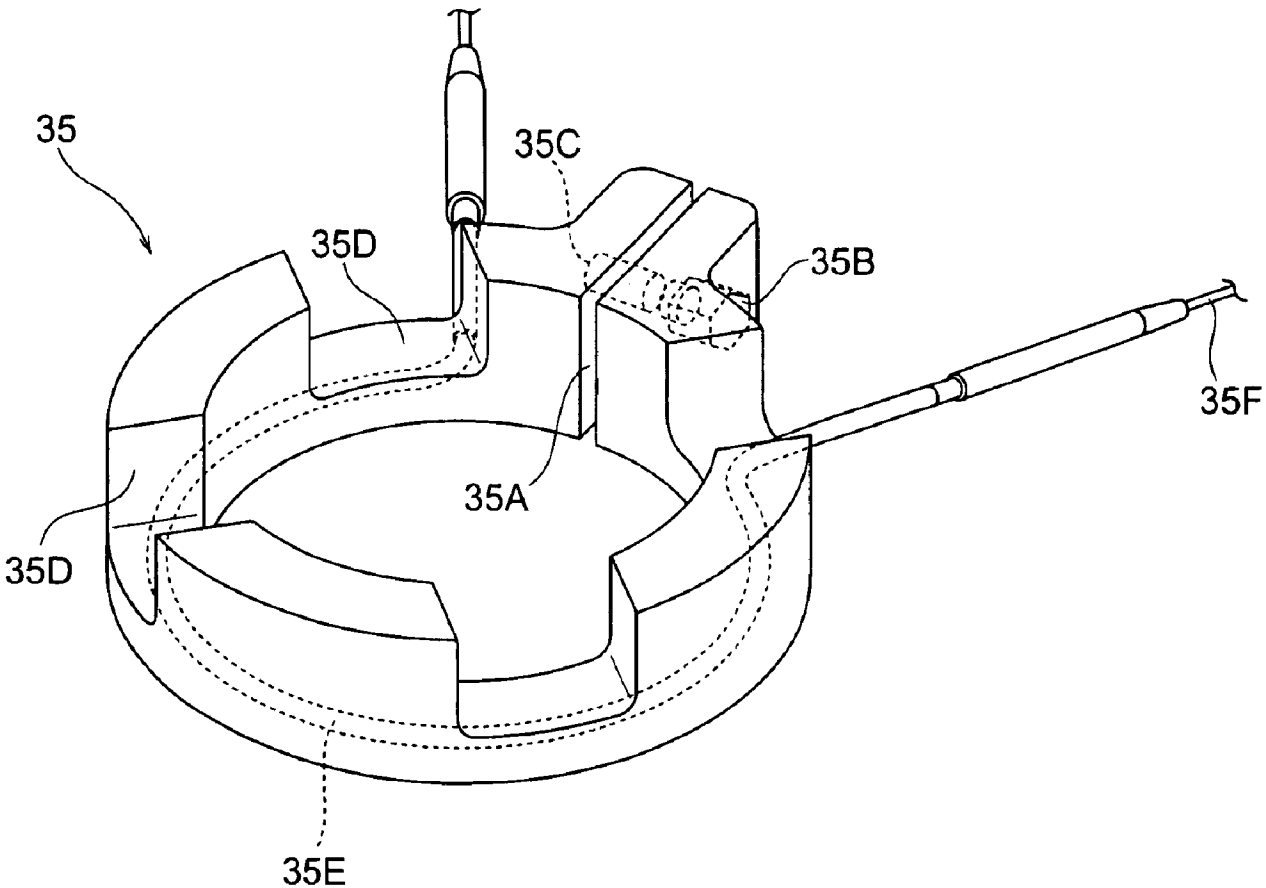
FIG. 4 is a perspective view showing the exterior of a cast-in heater in an embodiment of the auger type ice-making machine of the present invention.
Figure 5C:
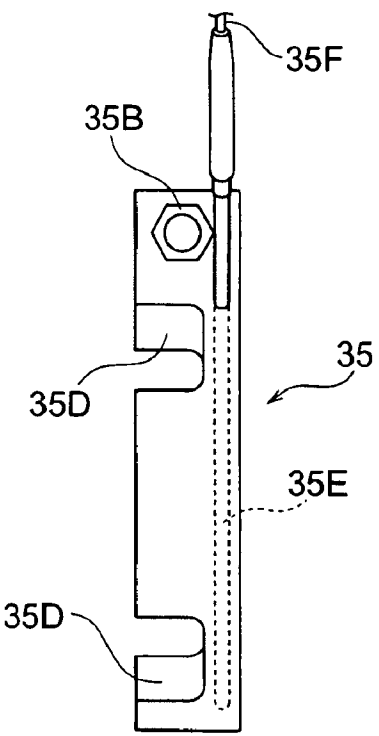
FIG. 5C is a side view of the cast-in heater of FIG. 4.
Figure 5A:
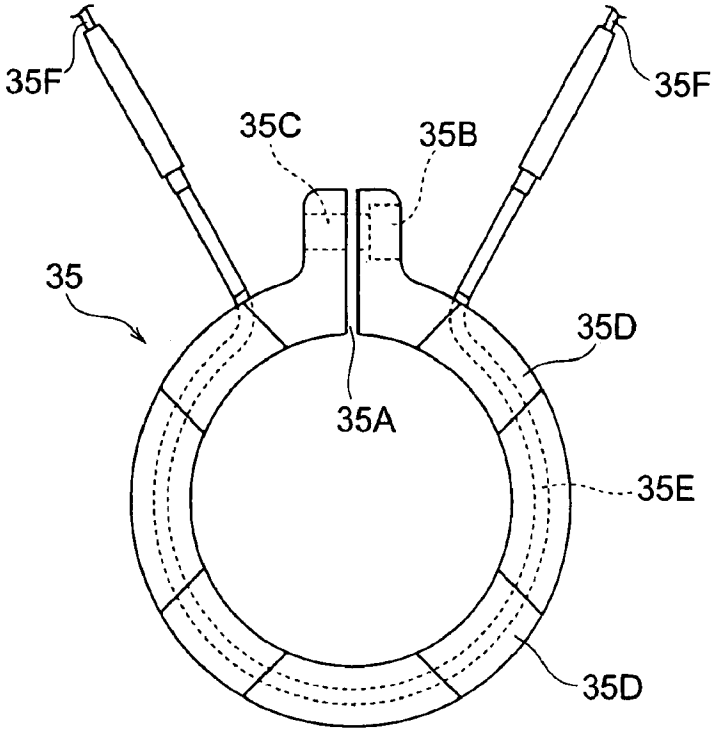
FIG. 5A is a plan view of the cast-in heater of FIG. 4.
Figure 5B:
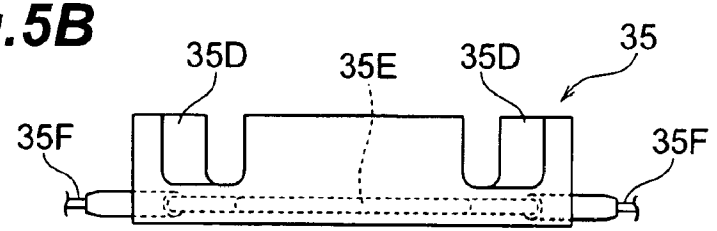
FIG. 5B is a front view of the cast-in heater of FIG. 4.

The aluminum cast-in heater 35 is shown in FIG. 4 and FIGS. 5A to 5C. FIG. 4 is a perspective view showing the exterior thereof, and FIGS. 5A to 5C show three faces thereof.

The aluminum cast-in heater 35 is produced by casting a sheath heater or cartridge heater inside an aluminum material, which is a metallic material with excellent thermal conductivity. The form at this time is created to match the form of the object to be heated. Heat generation in the interior of the heater is controlled by power supplied from a controller not shown in the drawings. As shown in FIG. 4, the aluminum cast-in heater 35 of the present embodiment takes a ring form having a slit 35A. A nut-bolt configuration is attached to each of the end portions forming the slit 35A to fasten these two end portions together. An attachment hole 35B for a hexagonal nut is formed in one of the end portions, and a bolt insertion hole 35C is formed in the other end portion.

A plurality of concave portions 35D are formed in the annular part of the cast-in heater 35 in order to avoid the aforementioned bolts 5. In this embodiment, a sheath heater 35E which generates heat by means of electric energy is buried in the annular part (a cartridge heater may also be used to increase the capacity). One end of the sheath heater 35E enters into the interior of the cast-in heater 35 from the vicinity of one end of the annular part, whereupon the sheath heater 35E goes around the interior of the cast-in heater 35 and comes out from the vicinity of the other end. Lead wires 35F covered in a heat-resistant/water-resistant coating are led out respectively from each end portion of the sheath heater 35E, and are connected to the aforementioned controller. Note that SUS304 or SUS316 is typically used for the outer pipe of the sheath heater 35E, but by applying copper plating to the outer surface thereof, heat dispersion is precipitated, and thus heat can be transmitted effectively to the aluminum parts of the cast-in heater 35.

Both the outer cylinder 36 and the cast-in heater 35 have slits, and hence when the cast-in heater 35 is fastened by the nut and bolt, the outer cylinder 36 fits perfectly onto the outer peripheral surface of the ice-making cylinder 19 and the cast-in heater 35 fits perfectly onto the outer peripheral surface of the outer cylinder 36. The cast-in heater 35 contacts fittingly to the ice-making cylinder 19 around the ice compression head 21 with sandwiching the outer cylinder 36, and hence heat from the cast-in heater 35 is reliably transmitted to the vicinity of the ice compression head 21, enabling reliable melting of the manufactured ice.

Further, the cast-in heater 35 is made of a metallic material, and therefore possesses good thermal conductivity. Also, the cast-in heater 35 is constituted by a mass of metallic material of a certain volume which itself has a certain thermal capacity. Accordingly, even when there are thermal fluctuations around the ice compression head 21, the cast-in heater 35 can respond sufficiently thereto by absorbing the fluctuations. The cast-in heater 35 also has the effect of reinforcing the ice-making cylinder 19 around the ice compression head 21 from the outside. Considerable pressure acts in the ice compression head 21 to compress the ice, and as a result, a load is placed on the ice-making cylinder 19 around the ice compression head 21. However, the ice-making cylinder 19 is covered by the cast-in heater 35, and hence deformation and so on of the ice-making cylinder 19 can be suppressed. In other words, the reinforcement performed by the cast-in heater 35 is extremely useful.

The outer cylinder 36 is constituted by copper, which is a metal with good thermal conductivity. In addition to copper, other examples of metals with good thermal conductivity include copper alloys (alloys consisting chiefly of copper), as well as gold, silver, aluminum and alloys consisting chiefly of these metals. In consideration of cost, ease of processing, and so on, however, copper is preferable. By means of the copper outer cylinder 36, heat generated by the cast-in heater 35 can be dispersed uniformly over a wide area. Moreover, the heat is transmitted quickly by the outer cylinder 36, which is advantageous in that heat generation control performed by the cast-in heater 35 can be reflected quickly. Further, by making the connecting area between the outer cylinder 36 and ice-making cylinder 19 larger than the connecting area of between the outer cylinder 36 and cast-in heater 35, a wider area can be heated than when heating is performed directly by the cast-in heater 35.

Figure 6:
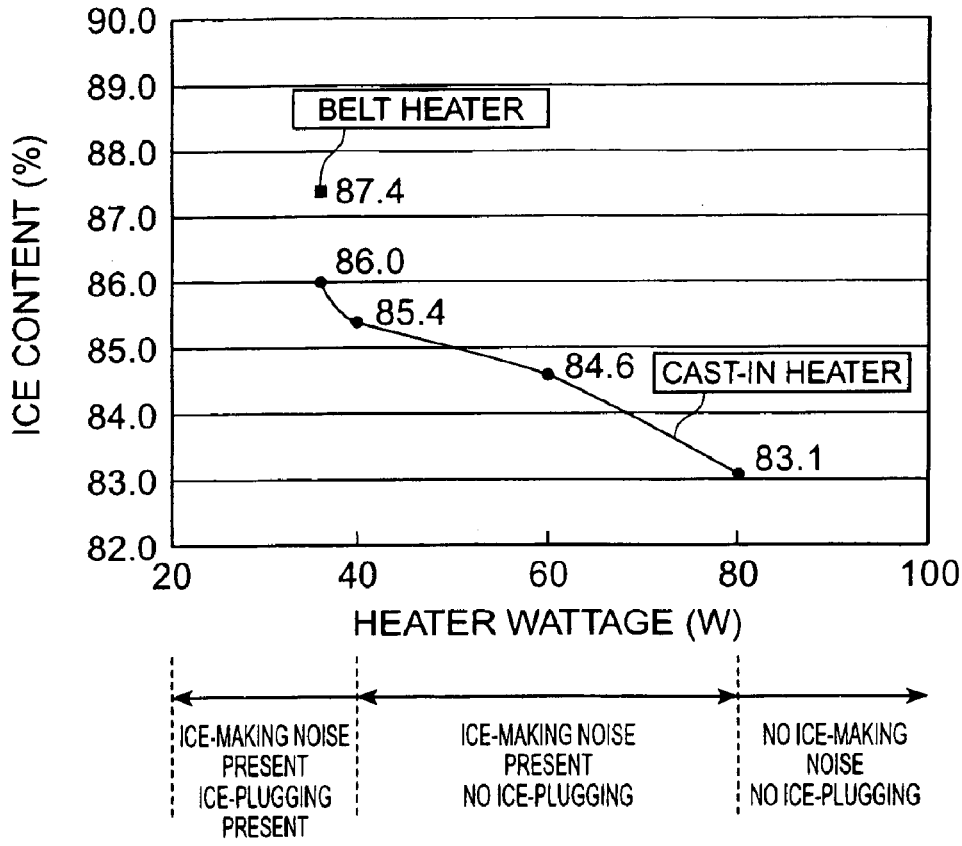
FIG. 6 is a graph showing the relationship between the wattage of the heater and the ice content.

FIG. 6 shows a graph indicating the results of an experiment for the effects of the present invention. In the graph in FIG. 6, the abscissa axis shows the wattage of the heater, and the ordinate axis shows the percentage of ice after removing water from manufactured ice of per unit weight (referred to here as the "ice content"). Variation of the ice content is plotted on the coordinate axes with changing the wattage in the case of a cast-in heater and a conventional belt heater (note, however, that in the case of a belt heater, only the result at 36 watts is plotted). Test conditions are At/Wt=20/15° C., 60 Hz, fan control OFF, and bypass control OFF, and a standard product of the ice compression head 21 without obstacle was used.

In the lower section of FIG. 6, the ice-making noise condition and ice-plugging condition are shown for each heater wattage area. Note that these conditions refer to a situation in which the ice compression head 21 returned from the market field is used (where At/Wt=5/5° C.). In other words, estimations with measuring the ice content is performed quantitatively using a standard product without obstacle, and performed qualitatively using a used product under actual usage conditions.

As can be seen from the result at 36 watts in the graph shown in FIG. 6, the ice content when a belt heater is used is higher than when a cast-in heater is used. This indicates that heat is not transmitted sufficiently to the ice with a belt heater. Further, the heat-resistance temperature and wattage density of a belt heater are low, and hence around 36 watts is the upper wattage limit. To raise the wattage further, wasteful extra components for increasing the heating area must be added. Conversely, a cast-in heater has a good heat resistance and the amount of heat can be further increased, thereby saving space and, due to the good heat transfer property of the cast-in heater, conserving energy. As can be seen from the ice-plugging condition shown at the bottom of FIG. 6, ice become stuck at 36 watts, which is the upper limit of a belt heater, but if a cast-in heater is used, the ice content can be reduced at the same wattage, enabling improvements such as the avoidance of ice-plugging.

Figure 7B:
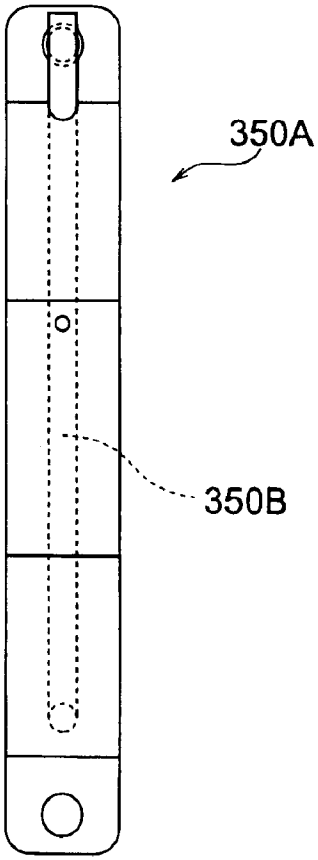
FIG. 7B is a side view showing the cast-in heater in the other embodiment of the auger type ice-making machine of the present invention.
Figure 7A:
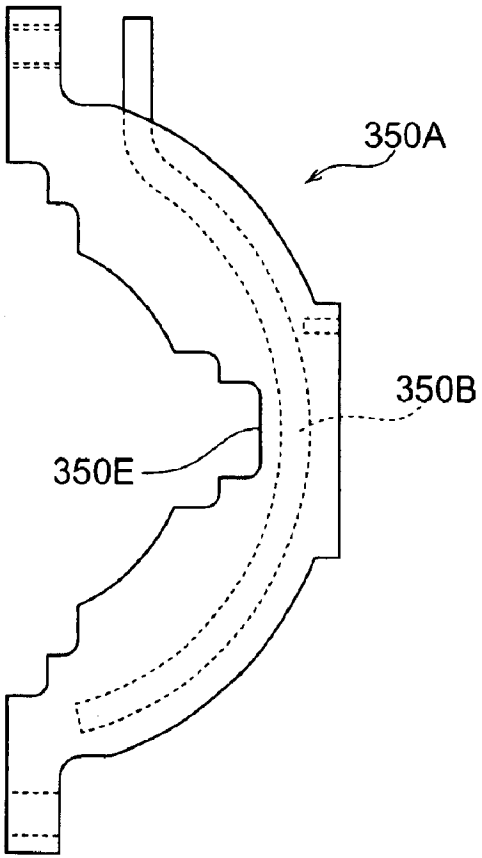
FIG. 7A is a plan view showing a cast-in heater in another embodiment of the auger type ice-making machine of the present invention.
Figure 8:
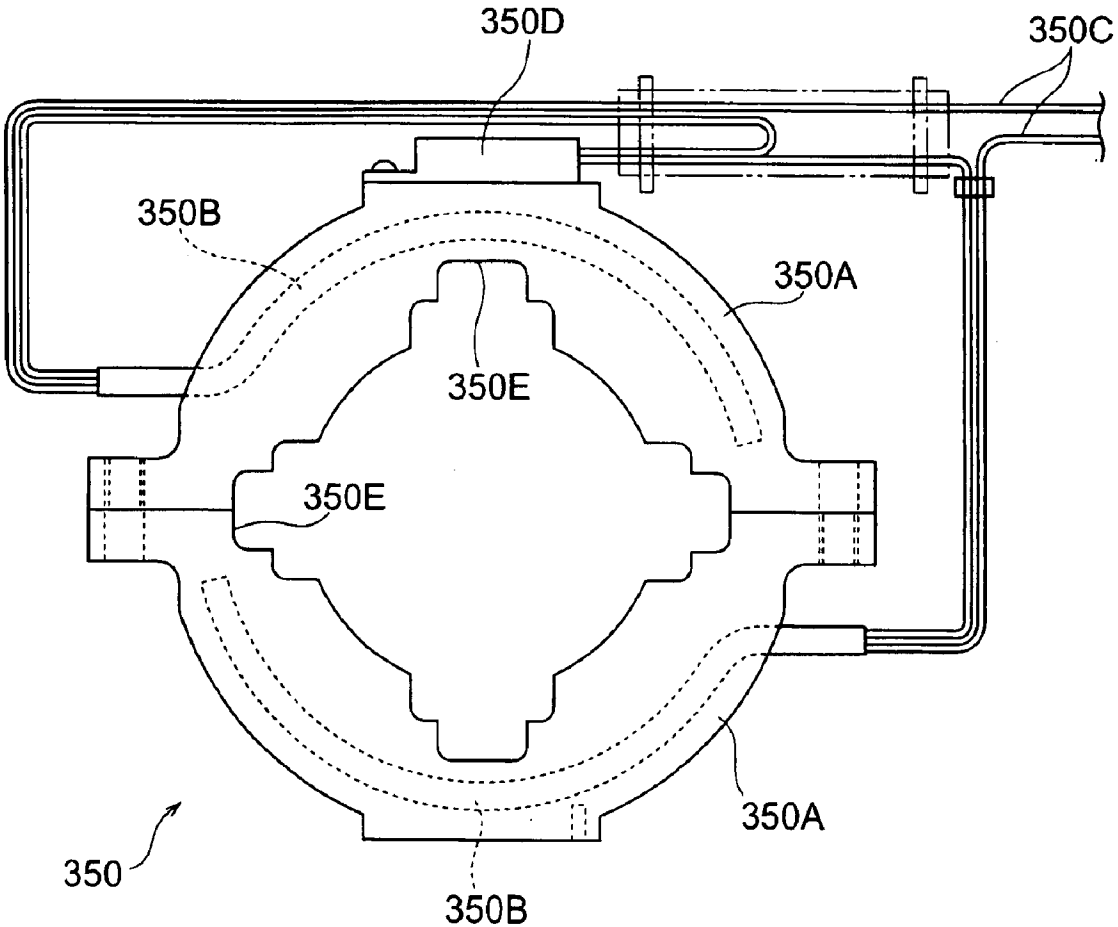
FIG. 8 is a plan view showing the cast-in heater of FIG. 7 following assembly.

FIGS. 7 and 8 show another embodiment of an aluminum cast-in heater. Since all other parts of the ice-making machine are identical to the embodiment described above, detailed description of them has been omitted, and a cast-in heater 350 will be described hereinbelow. In this embodiment, the cast-in heater 350 is divided into two. FIG. 7A shows a plan view of a divided unit 350A, and FIG. 7B shows a side view thereof. The annular cast-in heater 350 is constructed by combining two of the divided units 350A shown in FIG. 7. In the cast-in heater 350 of this embodiment, a cartridge heater 350B is implanted in an aluminum main body, and two lead wires are led out from each cartridge heater 350B.

The cast-in heater 350 in a state of usage is shown in FIG. 8. The end portions of the pair of divided units 350A are coupled with hexagonal-hole-equipped bolts. The cartridge heaters 350B are connected in series, and only two lead wires 350C are led to the controller from the cast-in heater 350. Intermediate connection portions of the two cartridge heaters 350B are stored in a protective portion 350D with water-resistance and heat-resistance, and then fixed to an attachment portion on one of the divided units 350A. A plurality of concave portions 350E are formed in the inner peripheral surface of the combined cast-in heater 350 in order to avoid the aforementioned bolts 5. By dividing the cast-in heater 350 into two in this manner, attachment is also possible to a component in which the flange 33 described above is welded to the ice-making cylinder 19 (such components having already been shipped into the market field).

Figure 9:
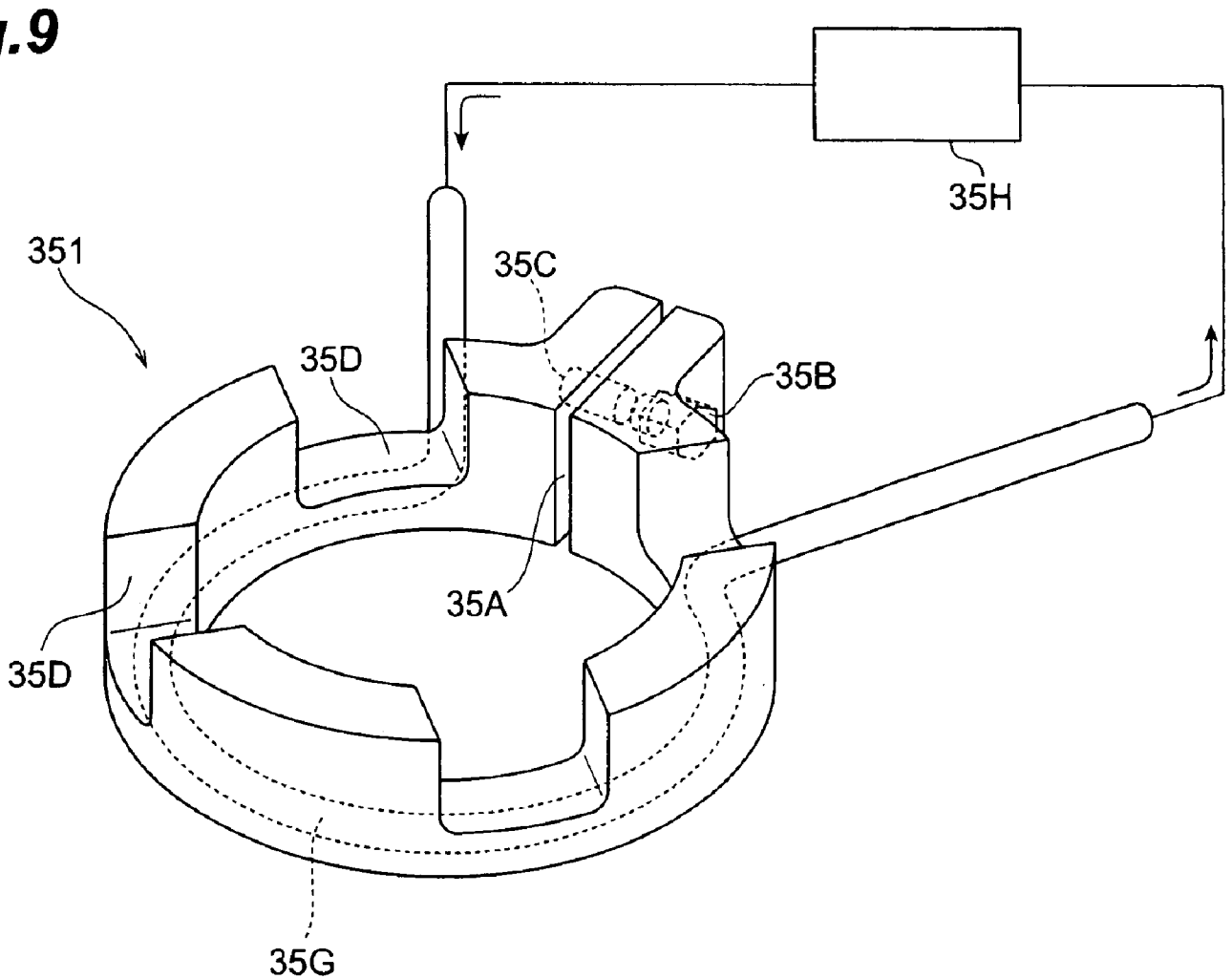
FIG. 9 is a perspective view showing the exterior of a cast-in heater in a further embodiment of the auger type ice-making machine of the present invention.

FIG. 9 shows a further embodiment of an aluminum cast-in heater. A cast-in heater 351 of this embodiment is cast with a pipe 35G which circulates hot gas in place of the sheath heater 35E of the cast-in heater 35 shown in FIG. 4. Accordingly, identical or similar parts with the embodiment in FIG. 4 have been allocated identical reference numbers and detailed descriptions for them have been omitted. This cast-in heater 351 is attached to the main body of the ice-making machine 1 with the aforementioned outer cylinder 36.

The cast-in heater 351 is constituted by a copper pipe 35G which circulates hot gas and is cast with an aluminum material. The pipe 35G serves as a heat generation source for transmitting the hot gas which circulates through its interior to the peripheral aluminum material. The two ends of the pipe 35G are connected to a refrigerating unit 35H of the ice-making machine 1. High-temperature, high-pressure gas containing heat generated by the refrigerating unit 35H is introduced from one of the end portions of the pipe 35G, and gas which has warmed the ice compression head 21 and thus fallen in temperature is discharged from the other end and returned to the refrigerating unit 35H. Having returned to the refrigerating unit 35H, this gas is used to cool the refrigerating unit 35H.

The material of the copper pipe 35H is heated during casting in the aluminum material, and hence oxygen free copper C1020 or the like is more suitable for use than tough pitch copper which easily becomes brittle. Moreover, since the copper pipe 35H also serves as a component of the refrigerating unit 35H, the interior of the pipe 35G must be subjected to cleaning processing following burning or inert gas exchange during casting. Also, the attachment environment of the cast-in heater 351 must be high in humidity with water droplets present at all times, and hence AC4C is suitable as an aluminum material. Note that here, hot gas is circulated through the pipe, but a liquid such as oil may also be circulated.

When hot gas (hot fluid) is used in this manner, cost increases that arise when electrical components are used in regard to electrical insulation (waterproofing, damp-proofing, resistance to deterioration, and so on), installation of a thermostat and the like, qualitative considerations (component fabricating process management), and so on, can be suppressed. Moreover, since the heater is constituted chiefly by two parts, the pipe and the cast material (aluminum material or the like), component costs and the number of manufacturing steps can be greatly reduced.

Note that similarly to the embodiment in FIG. 4 described above, in the embodiment shown in FIG. 9 the cast-in heater 351 fits perfectly onto the outer peripheral surface of the outer cylinder 36, and hence the manufactured ice can be reliably melted. The casting heater 351 also possesses good thermal conductivity and itself has a certain thermal capacity, enabling absorption of thermal fluctuations as in the embodiment in FIG. 4. The casting heater 351 also has the effect of reinforcing the ice-making cylinder 19. The effects caused by the outer cylinder 36 used in combination therewith are also similar to those of the embodiment in FIG. 4.

Note that the present invention is not limited to or by the embodiments described above, and various improvements and modifications may be implemented without departing from the scope of the present invention. For example, in the embodiments described above, the cast-in heater is made of aluminum (or an aluminum alloy consisting chiefly of aluminum), but the present invention is not limited solely to an aluminum cast-in heater. For example, a brass cast-in heater, aluminum bronze cast-in heater, or similar may be used. The heating temperature range differs according to the differences between these materials, and hence an optimum material may be selected appropriately.

Further, the outer cylinder 36 in the embodiments described above does not necessarily have to be provided, and a reduction in costs can be achieved by omitting the outer cylinder 36. Further, the cast-in heater 35 can be placed on the dew receiving dish 27 and fixed by the bolts 5 or the like. If position alignment of the boltholes is performed at a time when the cast-in heater 35 is placed on the dew receiving dish 27, the cast-in heater 35 can be attached more easily.

Alternatively, the cast-in heater 35 can be formed in a perfect ring form without the slit 35A, attachment holes 35B, bolt insertion holes 35C, and so on. In this case, the cast-in heater 35 may be fixed into position with the bottom thereof held by the dew receiving dish 27 and the top held down by the bolts 5. Grooves which engage with the bolts 5 may be formed on the upper face of the cast-in heater 35 at this time in order to prevent rotational deviation by the cast-in heater 35.

According to the auger type ice-making machine of the present invention, the use of cast-in heating means enables heat to be transmitted reliably to the ice compression head, thus melting the compressed ice such that the ice can be discharged smoothly. The use of cast-in heating means is also advantageous in improving the strength of the vicinity of the ice compression head (particularly the ice-making cylinder).

What is claimed is:

1. An auger type ice-making machine comprising: an ice-making cylinder which accommodates an auger rotatably in the interior thereof, an ice-compression head which supports an upper end portion of said auger rotatably, and which is disposed in an upper portion of said ice-making cylinder; and a cast-in heater disposed about and supporting an outer peripheral surface of an accommodating portion for said ice compression head of said ice-making cylinder.

2. The auger type ice-making machine according to claim 1, wherein a thermally conductive plate is disposed between said cast-in heater and said outer peripheral surface.

3. The auger type ice-making machine according to claim 1, wherein said cast-in heater comprises an electric heating element cast therein which generates heat by electrical energy.

4. The auger type ice-making machine according to claim 1, wherein said cast-in heater comprises an pipe heater cast therein which generates heat by circulating a heated fluid through the interior of said pipe heater.

5. The auger type ice-making machine according to claim 4, wherein the heated fluid which circulates through the interior of said pipe heater comprises a heated fluid that is discharged from a refrigerating unit of the ice-making machine.

6. The auger-type ice-making machine according to claim 1, wherein the cast-in heater comprises an annular member configured to fit about said outer peripheral surface.

7. The auger-type ice-making machine according to claim 6, wherein the annular member is formed in a plurality of sections.

8. The auger-type ice-making machine according to claim 6, wherein the cast-in heater has a plurality of slots formed therein corresponding to locations of a plurality of connecting devices on the ice compression head.

9. The auger-type ice-making machine according to claim 1, wherein the cast-in heater is removably disposed about the outer peripheral portion.

10. The auger-type ice-making machine according to claim 1, wherein the cast-in heater is fixed to the ice compression head.

* * * * *